United States Patent [19]

Foster

[11] 4,431,171

[45] Feb. 14, 1984

[54] APPARATUS FOR OPENING THE TAP HOLE OF A METALLURGICAL FURNACE

[75] Inventor: David W. Foster, Canonsburg, Pa.

[73] Assignee: Bailey Industrial Products, Inc., Washington, Pa.

[21] Appl. No.: 354,653

[22] Filed: Mar. 4, 1982

[51] Int. Cl.[3] ..... C21C 5/46

[52] U.S. Cl. ..... 266/271; 266/45; 266/287

[58] Field of Search ..... 266/45, 271, 287, 72, 266/73

[56] References Cited

U.S. PATENT DOCUMENTS

| | | | |
|---|---|---|---|
| 1,361,103 | 12/1920 | Scott | 266/271 |
| 3,121,769 | 2/1964 | Horn | 266/271 |
| 3,190,629 | 6/1965 | Draper | 266/271 X |
| 4,057,234 | 11/1977 | Brucher et al. | 266/271 X |

*Primary Examiner*—Brian E. Hearn
*Assistant Examiner*—David A. Hey
*Attorney, Agent, or Firm*—Carothers & Carothers

[57] ABSTRACT

Apparatus for tapping a wall of a metallurgical vessel wherein a drilling machine is carried by a mounting means for reversible displacement therealong on a track. The mounting means is suspended from a laterally extending boom which swings on a stationary support, and the boom is swung by a mechanism for selectively displacing the mounting means with its drill into an operative position for drilling a tap hole in a metallurgical vessel and an inoperative position. In one embodiment of the invention, the mounting means together with its guide track for carrying the drilling machine is pivotally connected to the boom and guide means are provided to guide the pivotal swinging of the mounting means relative to the boom to guide the mounting means over a predetermined path of movement when the boom is swinging. In a further embodiment, the boom is driven to swing in opposite directions with different motors respectively thereby permitting the boom to displace the mounting means to the inoperative position at a much more rapid rate than is desired for positioning the mounting means in the operative position. In yet a further embodiment, the mounting means together with its drilling machine is guided into and maintained in the proper operative position for tapping the vessel by an alignment strut which extends from the mounting means, the end of which is contactable with a stop which is prepositioned on the vessel to be tapped. Upon positioning in the operative position, the strut is continually driven into contact engagement with the stop without the requirement of additional mechanical locking mechanisms to maintain the drill in its proper prealigned operative position.

19 Claims, 2 Drawing Figures

APPARATUS FOR OPENING THE TAP HOLE OF A METALLURGICAL FURNACE

BACKGROUND OF THE INVENTION

The present invention relates generally to metallurgical apparatus and more particularly to apparatus for tapping a wall of a metallurgical vessel.

In order to open the tap hole of a shaft furnace such as a blast furnace, a drilling machine is utilized which is suspended from an apparatus that selectively displaces or moves the drilling machine into an operative position for drilling the tap hole and into an inoperative position upon completion of the drilling operation. Examples of such apparatus are illustrated in U.S. Pat. No. 3,121,769 issued on Feb. 18, 1964 to Walter Horn.

An important object of such tap hole drilling apparatus is to properly align the drilling machine in its operative position each time the furnace is tapped, such that it drills the same tap hole passage with the same inclination every time. Between each melt, the tap hole is filled with refractory clay and at the end of each melt, it is important that the same tap hole passage be drilled on each repeated opening. Otherwise, intersecting bore holes of different inclinations will result, such that on subsequent tap hole drilling operations, the drills are deflected and become jammed, and gradually the strength of the tap hole is reduced leading to possible premature ruptures. This will also cause the tap hole to eventually erode away into an undesirably much larger diameter.

The prior art tap hole drilling apparatus which utilize a swinging boom to position the drilling machine requires considerable room to operate, in order to position the drilling machine in the operative position and then in the inoperative position. This required the use of excessive working space for the machine which could otherwise be better put to use in the plant, and further limits the size of the drilling machine, requiring the use of smaller drilling machines than would otherwise be desired. In view of the fact that smaller drilling machines than desired must be utilized with the tap hole drilling apparatus of the prior art, the drilling time of the tap hole is undesirably increased.

In addition, the prior art drilling apparatus for the most part station the drilling machines in a suspended free-standing position such that the drilling machine is not positively positioned in relation to the tap hole to insure drilling of the same tap hole passage each time. Those prior art drilling machines which do employ some type of positioning mechanism, use a mechanical latching system to latch the drilling machine directly to the vessel to be tapped in order to positively position the machine. This is very undesirable, as the drilling machine cannot be rapidly displaced from the drilling operation without first unlatching it from the vessel. This time required in unlatching the drilling machine from the vesssel can be extremely critical, as damage will quickly occur to the drilling machine once the pour has started. In addition, the possible failure of the mechanical latching mechanism makes the situation even more critical, as a failure of the latching mechanism could cause irreparable damage to the drilling machine if the pour from the tap has already started and one is unable to detach the drilling machine from the furnace.

Another problem encountered with the tap hole drilling apparatus of the prior art is that it is desirable to position the drilling machine in its operative position for tap hole drilling at a relatively slow rate, and yet be able to retract the drilling machine very rapidly once the tap hole has been drilled. The prior art apparatus does not make provision for this, and the result is that the drilling machine is unduly subjected to excessive heat conditions at the time the furnace is tapped.

It is a principal object of the present invention to provide a tap hole drilling apparatus which is devoid of the afore-described disadvantages and which can positively align and position the drilling machine without the risk of mechanically latching it to the furnace, takes a minimum amount of space for positioning from the operative position to the inoperative position, while permitting the use of a relatively large and fast operating drill, and permits retraction of the drilling machine from the drilling operation at very rapid rates, yet permits positioning of the drilling machine in the operative position for tap hole drilling at slower rates.

SUMMARY OF THE INVENTION

The apparatus of the present invention for tapping a wall of the metallurgical vessel includes a mounting means forming a linear guide track with a drilling machine carried by the mounting means for reversible displacement along the track together with a boom swingable on a stationary support which suspends the mounting means laterally offset from the support. Mechanism is coupled with the stationary support and the boom for selectively displacing the mounting means together with its drilling machine into an operative position for tap hole drilling and an inoperative position by swinging the boom on the support.

Unlike such boom mechanisms of the prior art, the mounting means which carries the drilling machine is pivotally connected to the boom and a guide means or mechanism is connected to the mounting means and is adapted for guiding the pivotal swinging movement of the mounting means, and thereby also the drilling machine, relative to the boom to guide the drill mount over a predetermined path of movement when the boom is swinging. This guide mechanism permits the angular position of the drill mount relative to the boom to be regulated throughout the boom swing and thus permits full retraction of the drilling machine from the operative drilling position with a minimum requirement of movement and swing area for the apparatus. Thus, even though the drilling machine may be much larger in size than those of the prior art to provide a fast drilling operation, nevertheless, less operational area for the machine or apparatus is required, as will be more greatly appreciated hereinafter when reference is made to the drawings.

In its simplest form, the guide means for guiding the pivotal movement of the drill mount relative to the boom may consist of a strut of predetermined length which is pivotally connected at one end to the stationary support and pivotally connected at the other end to the mounting means or drill mount. Thus, as the boom is rotated or swung about the stationary support, the drill mount is forced to pivot in relation to the boom over a predetermined path of movement, depending upon the length of the strut and linkage members connected therewith. With this guide means, it is possible to substantially maintain the drill mount in continual parallel alignment with the original alignment of the drill and drill mount when it is in the operative position ready to drill, even though the boom is swinging through different angles of rotation.

In another embodiment of the present invention, two different but cooperatively operating motors are utilized to swing the boom respectively in opposite directions about the stationary support. The drilling machine can thus be positioned into the operative position for drilling at one speed and yet be very rapidly retracted at a much faster rate to the inoperative position.

In one preferred form, this mechanism for swinging the boom may take on the configuration of a pair of hydraulic cylinders which are operative in matched tandem and mounted in or on the boom with a chain connected therebetween and meshed with a stationary sprocket secured to the stationary support about which the boom swings. Thus, when one cylinder actuates, the other cylinder exhausts, thereby causing the boom to rotate about the stationary sprocket and support. The cylinder used to move the boom and drilling machine into the operative position is provided with a larger diameter for a slower stroke and greater force, and the cylinder utilized to retract the drilling machine and swing the boom in the opposite direction is a cylinder of smaller cross section, thereby having a much faster stroke to rapidly retract the drilling machine. This mechanism may all be safely enclosed within the boom structure thereby protecting it from heat exposure.

In yet a further embodiment of the present invention, a contact arm or strut means extends from the drilling end of the drill mount and is contactable with a stop secured to the side of the furnace or vessel when the drilling machine is in the operative position for drilling. Thus, as the drilling machine together with the strut advances toward the furnace to the operative position, the guide strut is received in the stop to accurately guide and position the drilling machine so that the tap hole in the vessel is always drilled precisely the same each time. The strut is continually urged into contact with the stop on the vessel by the motor means driving or swinging the boom, thus insuring continued alignment and further eliminating any actual mechanical latching contact between the drilling apparatus and the vessel, which could otherwise create hazardous conditions.

The stop on the furnace may simply take the form of an open-ended cup which tapers inwardly in its interior to initially receive the end of the strut extending from the drill machine and to guide it to a final rest position when the drilling machine is in its operative position for drilling.

BRIEF DESCRIPTION OF THE DRAWINGS

Other objects and advantages appear in the following description and claims.

The accompanying drawings show, for the purpose of exemplification without limiting the invention or the claims thereto, certain practical embodiments illustrating the principles of this invention wherein:

DETAILED DESCRIPTION OF THE PREFERRED EMBODIMENTS

Figure 1:
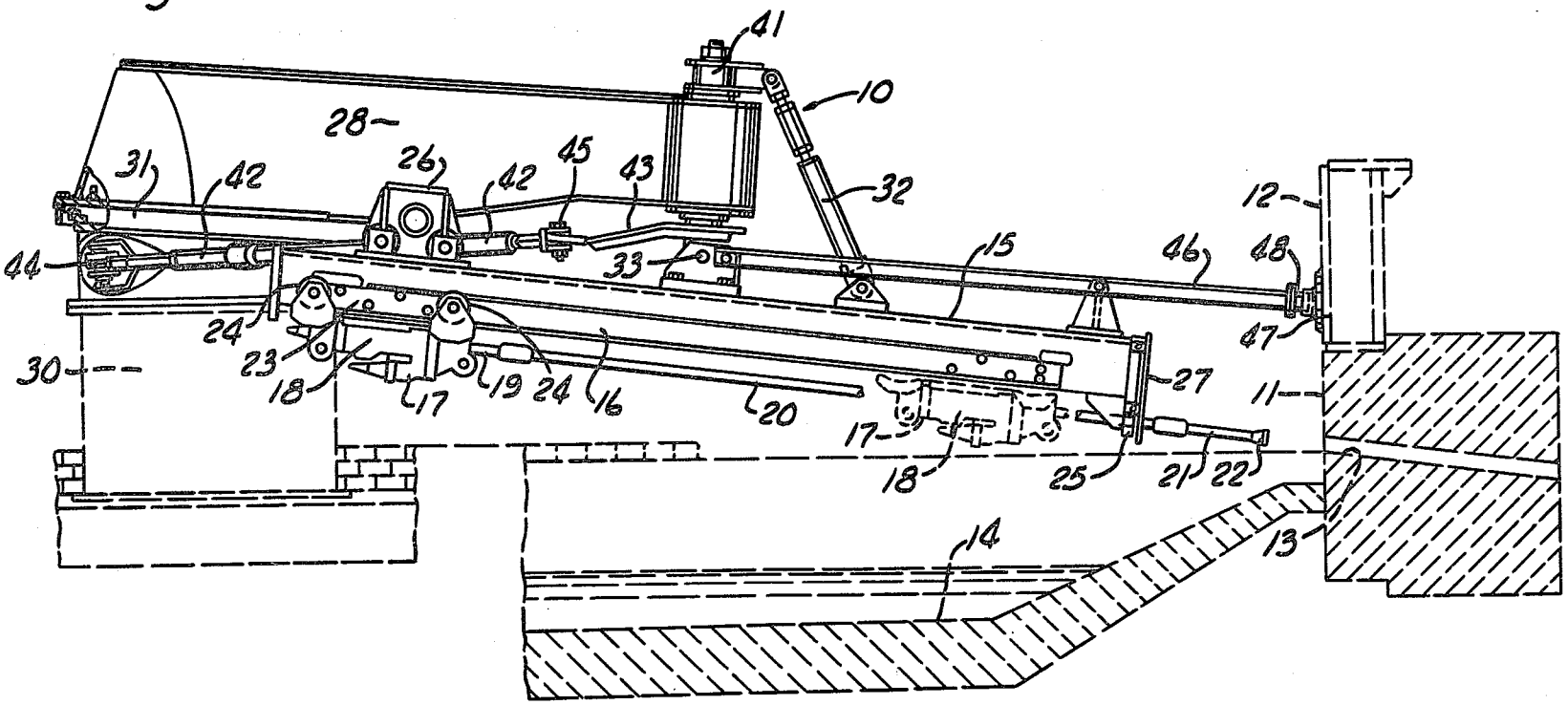
FIG. 1 is a view in side elevation of the tap hole drilling apparatus of the present invention illustrated in the operative position ready for tap hole drilling of a metallurgical vessel.

Referring to the Figures, the apparatus 10 for tapping a wall 11 of metallurgical vessel or furnace 12 is illustrated. In the drawings, the apparatus is illustrated in the operative position ready to drill out the tap hole 13 of the metallurgical vessel 12 to permit molten metal from the vessel to pour into tap hole runner 14 of the furnace or vessel.

Prior to metallurgically processing ingredients within the furnace 12, tap hole passage 13 is filled with refractory clay through the use of a conventional clay gun. Thereafter, the metallurgical melting function is carried out within vessel 12, and when the process is finished, the vessel must be tapped by again drilling out tap hole passage 13 to permit the molten metal to drain into tap hole runner 14.

Tap hole drilling apparatus 10 of the present invention generally consists of a drill mount or mounting means 15 forming or providing a linear guide track 16 for drilling machine 17 which is carried by drill mount 15 for reversible displacement along the track. Drilling machine 17 is a conventional rotary impact type drill having a pneumatic motor 18, which drives striker bar 19 which in turn is connected through conventional couplings to connecting rod 20, connecting rod 20 in turn being connected through a conventional coupling to drill bit adaptor 21 having drill bit 22 secured to the forward end thereof.

Drilling machine 17 is supported by drill mount or mounting means 15 along track 16 by means of carriage 23 and trolley wheels 24 which ride on track 16. The forward end of connecting rod 20 is also supported by forward bearing 25.

Feed motor 26 is also mounted onto drill mount 15 and is coupled through a conventional chain and sprocket system to drill mount carriage 23 for effecting the reversible displacement of drill machine 17 along track 16. This is indicated in FIG. 1 by the dashed outline of drilling machine 17, wherein it is illustrated in its most forward advanced position along track 16 in the drilling operation. The forward end of drill mount 15 is provided with heat shield 27 to protect drill motor 18 from the extreme heat emanating from the molten metal pouring from tap hole 13 after the same has been drilled.

Drill mount or mounting means 15 is suspended from boom 28 and boom 28 is, in turn, swingably mounted on stationary support 30. Thus, boom 28 suspends drill mount 15 in a laterally-offset position from stationary support 30. Boom 28 rotates on top of stationary support 30 on an inclined transverse plane 31 which is generally in parallel with the incline of the axis of tap hole passage 13. Thus, when boom 28 is swung to the right or forward as viewed in the Figures, to position drill mount 15 together with drilling machine 17 in the operative position, as illustrated in the Figures in full lines, so that drilling machine 17 may drill tap hole 13, drilling machine 17 and drill mount 15 are already roughly positioned on the proper inclination for alignment with tap hole 13. Additional minor adjustments of tilt for drill mount 15 may further be accomplished by activation of turnbuckle 32. Activation of turnbuckle 32 rotates drill machine mount 15 about pivot axis 33, which is the connection point of suspension for drill mount 15 from boom 28.

The inclined journal at 31 for boom 28 also serves the purpose that when boom 28 is swung to the left or clockwise, to displace drilling machine mount 15 from the operative position as illustrated in full line to an inoperative position as illustrated in broken outline (FIG. 2), this also has the effect of automatically and simultaneously raising drilling machine 17 together with drilling machine mount 15 farther away from the molten metal moving in run-off 14, thereby adding added heat protection therefor.

Figure 2:
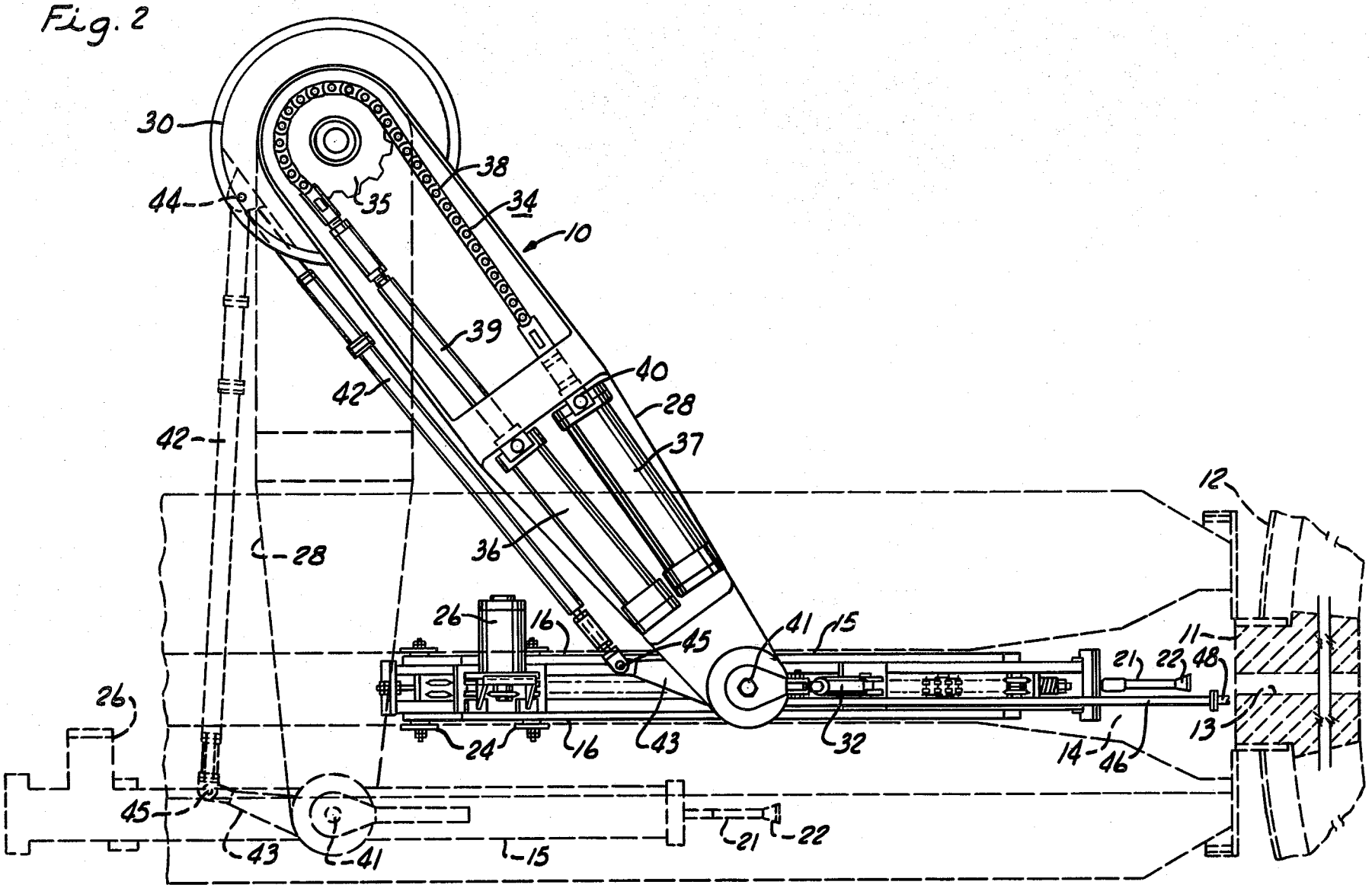
FIG. 2 is a plan view of the tap hole drilling apparatus illustrated in FIG. 1 with portions thereof shown in broken outline to illustrate different operative positions of the apparatus.

Boom 28 is rotated or swung about stationary support 30 by means of mechanism generally indicated at 34 in FIG. 2. This mechanism is housed within the confines of boom 28 for heat protection. Cover plates on the top of boom 28 as seen in FIG. 2 have been removed to expose mechanism 34 for the purpose of this description.

Mechanism 34 is operable to selectively displace drilling machine mount 15 into the operative position for drilling as illustrated in full lines in FIGS. 1 and 2 and an inoperative position as illustrated in dashed outline in FIG. 2. The dashed outline indicates only one of a number of possible inoperative positions, as boom 28 may be swung further clockwise or to the left than is indicated by the dashed outline in FIG. 2.

Mechanism 34 which swings boom 28 is generally comprised of stationary sprocket 35 which is mounted on stationary support 30, two motor means in the form of single acting hydraulic cylinders 36 and 37, and a chain 38 drivingly connected at opposite ends to the piston rods 39 and 40 of cylinders 36 and 37 respectively, with the chain meshed with sprocket 35. Hydraulic cylinders 36 and 37 are operated in matched tandem, or cooperatively with each other, such that when hydraulic cylinder 37 is actuated to draw in its piston rod 40, boom 28 rotates to the right or in the counterclockwise direction as seen in FIG. 2 to position drilling machine 17 together with its support 15 in the operative position as illustrated in the Figures. While cylinder 37 is activated to thus swing boom 28, piston rod 39 is extending from cylinder 36 and the hydraulic fluid within cylinder 36 is thus cooperatively slowly bleeding off to tank.

On the other hand, when cylinder 36 is activated to swing boom 28 to the left or clockwise, cylinder 37 is bleeding off to tank in cooperation therewith, and this causes boom 28 to rotate clockwise due to the fact that sprocket 35 is stationary and chain 38 is meshed therewith.

It should further be noted that hydraulic cylinder motor 37 is larger in diameter than cylinder motor 36. Thus, when cylinder 37 is actuated to position drilling machine mount 15 into the operative position, a relatively slow rate of speed is utilized. Moreover and more importantly, the larger cylinder provides sufficient force to hold the drill frame against the furnace while drilling, thereby preventing the drill from backing out. However, when cylinder 36 is actuated, it has a much smaller diameter, and therefore a much faster stroke than cylinder 37, and thus drilling machine mount 15 is displaced very rapidly to its inoperative position. This is necessary in order to fully protect the equipment, as a very rapid retreat must be made when the hot metal pour begins through tap hole 15.

Mounting means or drilling machine mount 15 is pivotally connected to boom 28 on end shaft 41. Machine mount 15 would thus be otherwise free to rotate relative to boom 28 except the pivotal rotation of drilling machine mount 15 is guided over a predetermined path of movement by a guide means in the form of guide strut 42 and linkage arm 43. Guide strut 42 is pivotally connected at one end 44 to stationary support 30 and is pivotally connected at the other end to mount 15 at 45 via linkage arm 43. Linkage arm 43 is rigid with or rotates with and guides mount 15.

The length of guide strut 42 and arm 43 are set to a predetermined length in order to guide the pivotal movement of mount 15 relative to boom 28 while boom 28 is swinging about support 30. However, guide strut 42 is spring loaded for compression to allow for slight misalignments as explained hereinafter. These lengths are adjusted to substantially maintain mount 15 in parallel alignment with the alignment of the mounting means when it is in the operative position. In this regard, it may be noted in FIG. 2 that the dashed outline of drilling machine mount 15 is substantially aligned in parallel with mount 15 as illustrated in full line.

This guide arrangement not only permits accurate lineup of mount 15 and drilling machine 17 when it is being advanced to the operative position for drilling, but also permits boom 28 and its support 30 to be positioned farther away from furnace 12, thereby protecting it more from the heat of the pour, than would otherwise be possible with the prior art drilling machine apparatus. Additionally, this guide arrangement also permits the use of a minimum amount of space for positioning the guide means from its operative position to its inoperative position than was heretofore possible with prior art drilling apparatus utilizing a swing boom. This ability to use minimal operating space further lends itself to the ability to use larger and therefore much faster drilling machines.

To further insure that the drilling machine 17 and drilling machine mount 15 are absolutely properly aligned for the drilling of tap hole 13 each time a melt is completed in vessel 12, a strut 46 is securely mounted to mount 15 and extends from the forward end thereof for guided contact engagement with stop 47 which is prepositioned and secured on the wall of furnace 12. Thus, when mount 15 is advanced to the operative position for drilling as illustrated in the Figures, by mechanism 34, locating block 48 secured to the forward end of strut 46 is received in the opening of stop 47, which is in the form of an open cup and has an inside annular wall surface which converges inwardly toward the bottom thereof, to guide locating block 48 to the proper central position at the bottom of stop cup 47. Cup 47 is also positioned very accurately on the wall of furnace 12 so that the drill bit 22 and rods 20 and 21 are accurately aligned with the axis of passage 13 to be tapped.

After the forward end of strut 46 has been guided into and seated in stop 47, mechanism 34 which drives boom 28 continues to continually urge strut 46 into contact engagement with stop 47. This is accomplished by continually maintaining cylinder 37 under normal hydraulic supply or system pressure.

Guide strut 42 is also spring loaded (not shown) in order that strut 46 may locate or seat in stop 47 with negligible side force. The side force could otherwise be considerable if there was some slight misalignment and the guide strut 42 was required to be a fixed length.

In this manner, the drilling machine 17 is always assured to be in proper alignment without the requirement of actually having to mechanically latch the guide 15 to the wall of furnace 12. Thus, when a quick retraction or displacement of drilling machine 17 is required, no mechanical detachment is necessary and the insecurity of having a mechanical latching mechanism fail, such that it is unable to be unlatched, is also avoided.

I claim:

1. Apparatus for tapping a wall of a metallurgical vessel including, mounting means forming a linear guide track, a drilling machine carried by said mounting means for reversible displacement along said track, motor means on said mounting means coupled with said drilling machine for effecting the reversible displacement thereof, stationary supporting means, a boom swingable on said supporting means and suspending said mounting means laterally offset from said supporting means, and mechanism coupled with said supporting means and said boom for selectively displacing said mounting means into an operative position and an inoperative position by swinging said boom on said supporting means, the improvement comprising, said mechanism including stationary sprocket means on said stationary supporting means, two motor means mounted on said boom and having flexible chain driving means connected at opposite ends therebetween with said chain means meshed with said sprocket means, said two motor means operable in cooperation with each other on said chain means to swing said boom about said stationary sprocket means and said support means.

2. The apparatus of claim 1, wherein said motor means which swings said boom to thereby displace said mounting means into said inoperative position from said operative position is adapted to swing said boom faster than the other of said motor means.

3. The apparatus of claim 8, wherein said pair of motor means consists of a pair of hydraulic cylinders operable in matched tandem.

4. The apparatus of claim 3, wherein said hydraulic cylinders are single acting.

5. The apparatus of claim 4, wherein the hydraulic cylinder operable to position said mounting means into said inoperative position has a smaller cylinder diameter than the other of said cylinders thereby providing said smaller cylinder with a faster stroke, said cylinders being hydraulically connected in matched tandem.

6. The apparatus of claim 1, said mounting means pivotally connected to said boom, and guide means connected to said mounting means and adapted for guiding the pivotal swinging of said mounting means relative to said boom to guide said mounting means over a predetermined path of movement when said boom is swinging.

7. The apparatus of claim 6, said guide means consisting of a strut of predetermined length pivotally connected at one end to said stationary supporting means and pivotally connected at the other end of said mounting means.

8. The apparatus of claim 7, wherein said guide means is adapted to substantially maintain said mounting means while being displaced by said mechanism in parallel alignment with the alignment of said mounting means when in said operative position.

9. The apparatus of claim 1, including alignment strut means extending from said mounting means and locating stop means fixed at a predetermined position on a metallurgical vessel to be tapped, said strut means contactable with said stop means when said mounting means is in said operative position to prealign said drilling machine for tapping the vessel, and drive means to continually urge said strut means into contact engagement with said stop means when said mounting means is in said operative position.

10. The apparatus of claim 9, wherein said drive means consists of said mechanism for displacing said mounting means.

11. Apparatus for tapping a wall of a metallurgical vessel including, mounting means forming a linear guide track, a drilling machine carried by said mounting means for reversible displacement along said track and having a boring tool engaged therewith and extending from one end of said mounting means for tap hole boring, motor means on said mounting means coupled with said drilling machine for effecting the reversible displacement thereof, stationary supporting means, suspension means for said mounting means on said supporting means, and mechanism coupled between said supporting means and said suspension means for selectively displacing said mounting means into an operative position and an inoperative position, the improvement comprising, alignment strut means extending from said one end of said mounting means and locating stop means fixed at a predetermined position on a metallurgical vessel to be tapped, said strut means contactable with said stop means when said mounting means is in said operative position to prealign said boring tool for tap hole boring, and drive means to continually urge said strut means into contact engagement with said stop means when said mounting means is in said operative position.

12. The apparatus of claim 11, said locating stop means consisting of a locating cup secured to said vessel to guidingly receive a free end of said strut means therein as said mounting means is advancing into said operative position.

13. The apparatus of claim 11, wherein said drive means consists of said mechanism for displacing said mounting means.

14. The apparatus of claim 11, said suspension means consisting of a boom swingable on said supporting means and suspending said mounting means laterally offset from said supporting means.

15. The apparatus of claim 14, said mounting means pivotally connected to said boom, and guide means connected to said mounting means and adapted for guiding the pivotal swinging of said mounting means relative to said boom to guide said mounting means over a predetermined path of movement when said boom is swinging.

16. The apparatus of claim 15, said guide means consisting of a strut of predetermined length pivotally connected at one end of said stationary supporting means and pivotally connected at the other end to said mounting means.

17. The apparatus of claim 16, wherein said guide means is adapted to substantially maintain said mounting means while being displaced by said mechanism in parallel alignment with the alignment of said mounting means when in said operative position.

18. The apparatus of claim 14, said mechanism including two motor means connected between said stationary support means and said boom and adapted to respectively swing said boom in opposite directions about said support means.

19. The apparatus of claim 18, wherein said motor means which swings said boom to thereby displace said mounting means into said inoperative position from said operative position is adapted to swing said boom faster than the other of said motor means.

* * * * *